US006293822B1

(12) United States Patent
Zhu et al.

(10) Patent No.: US 6,293,822 B1
(45) Date of Patent: Sep. 25, 2001

(54) ELECTRICAL CONNECTOR

(75) Inventors: ZiQiang Zhu; ZhongHua Yao; Zhiquan Mou, all of Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/548,900

(22) Filed: Apr. 13, 2000

(30) Foreign Application Priority Data

Mar. 15, 2000 (TW) ..... 89204153

(51) Int. Cl.[7] ..... H01R 13/73
(52) U.S. Cl. ..... 439/567
(58) Field of Search ..... 439/567, 571, 439/572, 607–610

(56) References Cited

U.S. PATENT DOCUMENTS 5,356,313 * 10/1994 Niwa et al. ..... 439/567
5,709,556 * 1/1998 Tan et al. ..... 439/567
5,797,769 * 8/1998 Yang et al. ..... 439/567
6,083,044 * 7/2000 Wang et al. ..... 439/567
6,086,418 * 7/2000 Chang ..... 439/567
6,095,853 * 10/1994 Huang et al. ..... 439/567

* cited by examiner

*Primary Examiner*—Gary F. Paumen
(74) *Attorney, Agent, or Firm*—Wei Te Chung

(57) ABSTRACT

An electrical connector includes an insulative housing, a number of contacts, a pair of fixing screws, and a first and second types of fixing devices. The housing forms a number of passageways for receiving corresponding contacts therein. The first and second types of fixing devices each comprise at least a pair of boardlocks for extending through corresponding holes in the housing and into a circuit board. Thus, the electrical connector can be securely mounted on the circuit board.

1 Claim, 6 Drawing Sheets

ELECTRICAL CONNECTOR

BACKGROUND OF THE INVENTION

The present invention relates to an electrical connector, and particularly to an electrical connector with fixing devices for securely mounting the connector on a printed circuit board for ensuring a reliable electrical signal transmission between the connector and the printed circuit board.

With the rapid development of electronic technology, electronic products are required to have highly reliable signal transmission capabilities. To achieve this reliability, electrical connectors for firmly fixed to their corresponding circuit board so that terminals of the connector can be securely connected with circuit traces on the printed circuit board. A fixing device is needed to fix the connector at a preselected position relative to the printed circuit board in order to prevent the connector from floating during soldering.

Related inventions are disclosed in U.S. Pat. Nos. 5,085,589 and 5,004,430. Referring to FIG. 1, a conventional electrical connector 7 is used for mounting on a printed circuit board (not shown). The electrical connector 7 comprises an insulative housing 70 which defines a plurality of passageways 77 for receiving corresponding contacts 9 therein. A D-shaped projection 76 extends from a front side of body portion 71 and is covered by a metal shroud 8. The body portion 71 defines a pair of fixing holes 75 at lateral sides thereof for receiving corresponding fixing screws 11 extending therethrough. A pair of flat plates 73 is formed at lateral sides of the housing 70. A pair of locking holes 74 is defined in the plates 73 for receiving corresponding boardlocks 102 integral formed a pair of fixing elements 10.

After assembly, the boardlocks 102 extend through the locking holes 74 and fix the electrical connector 7 to the printed circuit board. However, since the insulative housing 70 has no positioning means for accommodating the fixing elements 10. The fixing elements 10 are difficult to retain properly positioned in the corresponding locking holes 74 during assembly. Furthermore, if the insulative housing 70 has an elongated shape, the conventional fixing elements 10 can not reliably fix the electrical connector 7 to the circuit board.

Thus there is a need for an improved fixing device for reliably attaching the electrical connector to the circuit board.

BRIEF SUMMARY OF THE INVENTION

A main object of the present invention is to provide an electrical connector having a fixing device for reliably securing the electrical connector to a circuit board.

Another object of the present invention is to provide an electrical connector having a fixing device which can be easily assembled to the electrical connector.

To fulfill the above-mentioned objects, an electrical connector according to a preferred embodiment of the present invention, comprises an insulative housing having a D-shaped projection extending from a front side thereof. The insulative housing defines a plurality of passageways for receiving corresponding contacts therein. A metal shroud is shaped with a frame for receiving the corresponding D-shaped projection therein. A pair of extending plates respectively extends from lateral sides of the housing. Each extending plate defines a receiving space therein. A protrusion is formed adjacent to a rear end of the receiving space. The protrusion forms a pair of channels at lateral sides thereof.

The electrical connector further comprises a first and a second type of fixing devices. The first type of fixing device has an elongated body which defines a mating opening therein. A pair of front and rear boardlocks respectively extend from front and rear ends of the body. The second type of fixing device has a similar configuration to that of the first type except that the second type of fixing device only has a pair of rear boardlocks. After the boardlocks have been extended through the extending plates of the housing and into corresponding holes defined in a circuit board, the electrical connector is securely mounted on the circuit board.

Other objects, advantages and novel features of the invention will become more apparent from the following detailed description when taken in conjunction with the accompanying drawings.

DETAILED DESCRIPTION OF THE INVENTION

Figure 1:
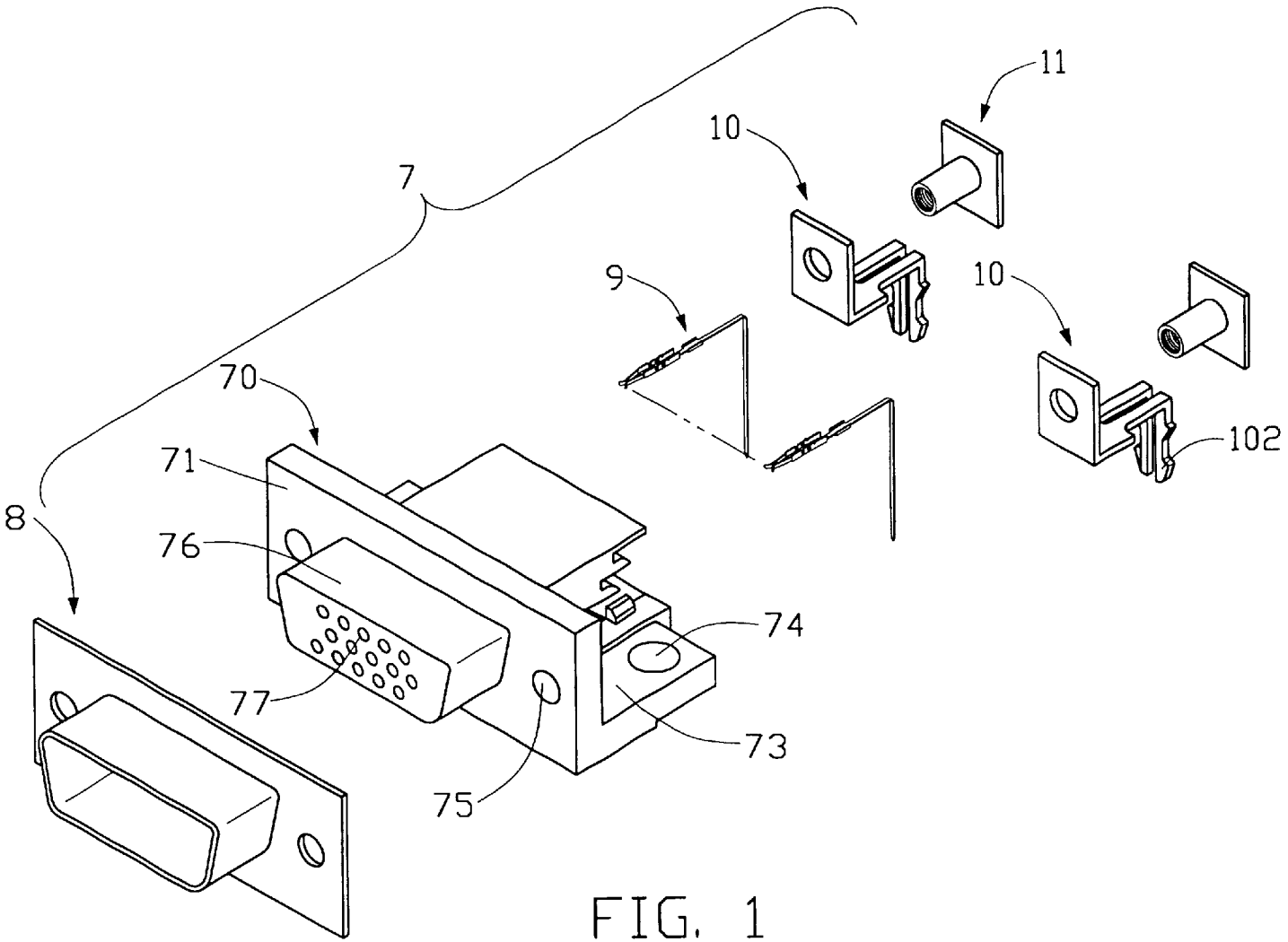
FIG. 1 (PRIOR ART)
FIG. 1 is an exploded, perspective view of a conventional electrical connector.
Figure 2:
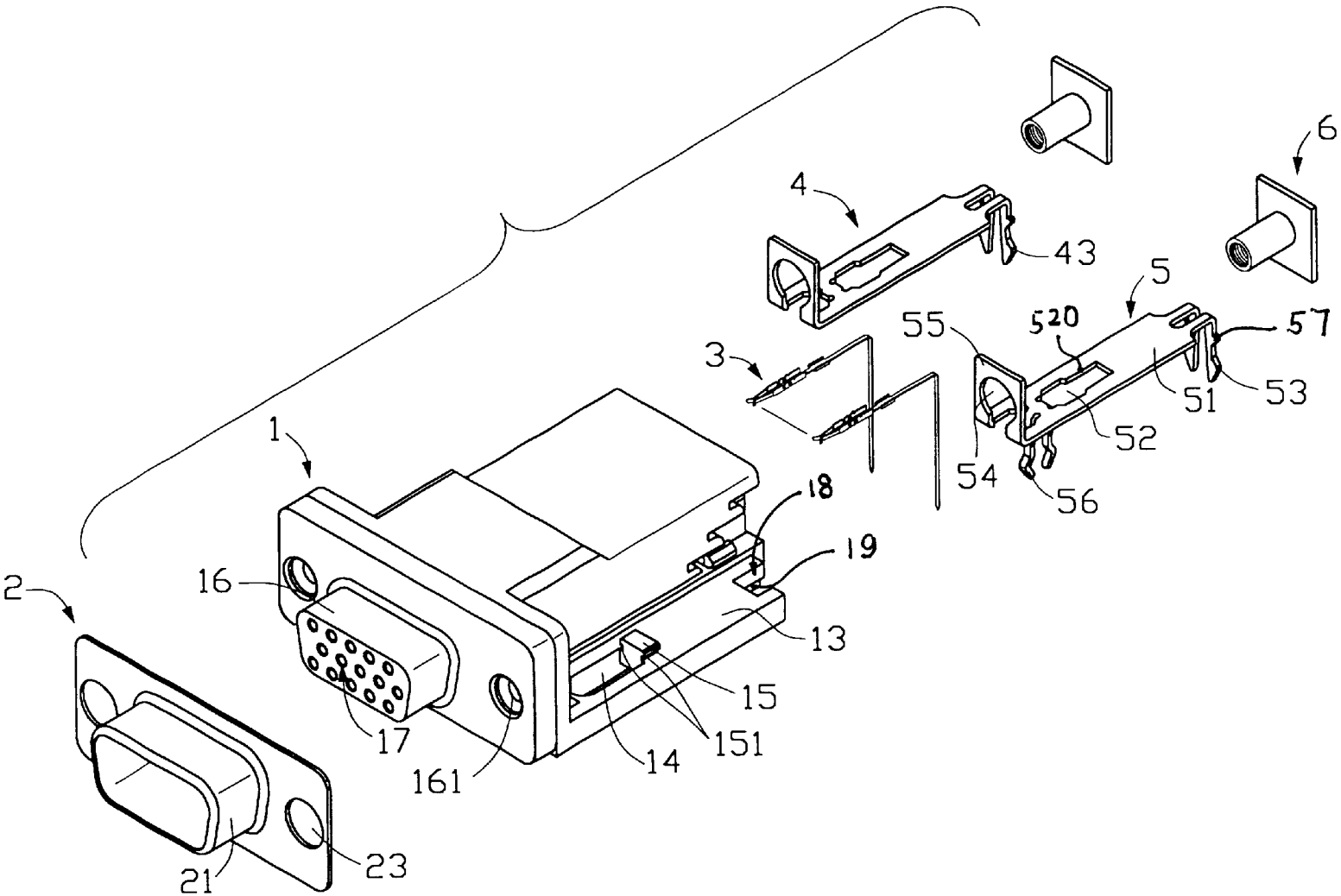
FIG. 2 is an exploded, perspective view of an electrical connector in accordance with the present invention.
Figure 3:
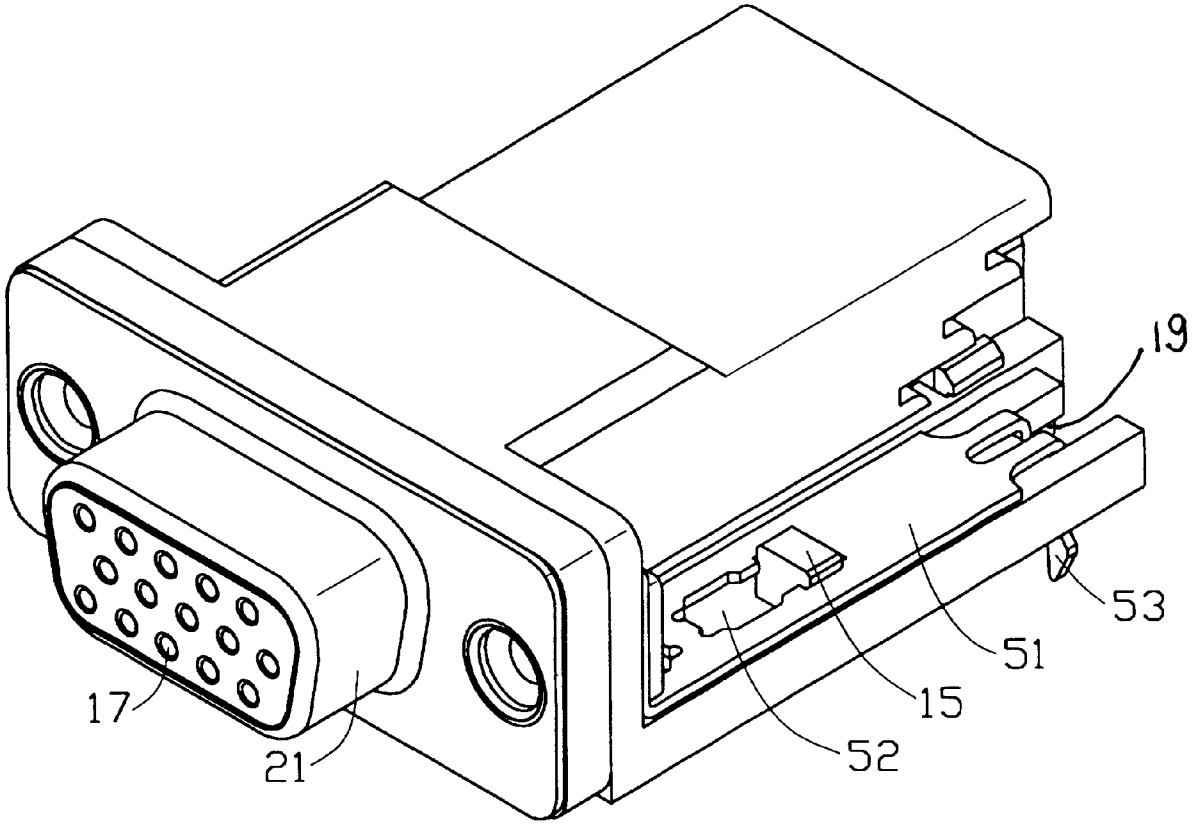
FIG. 3 is a perspective view of the assembled electrical connector.
Figure 4:
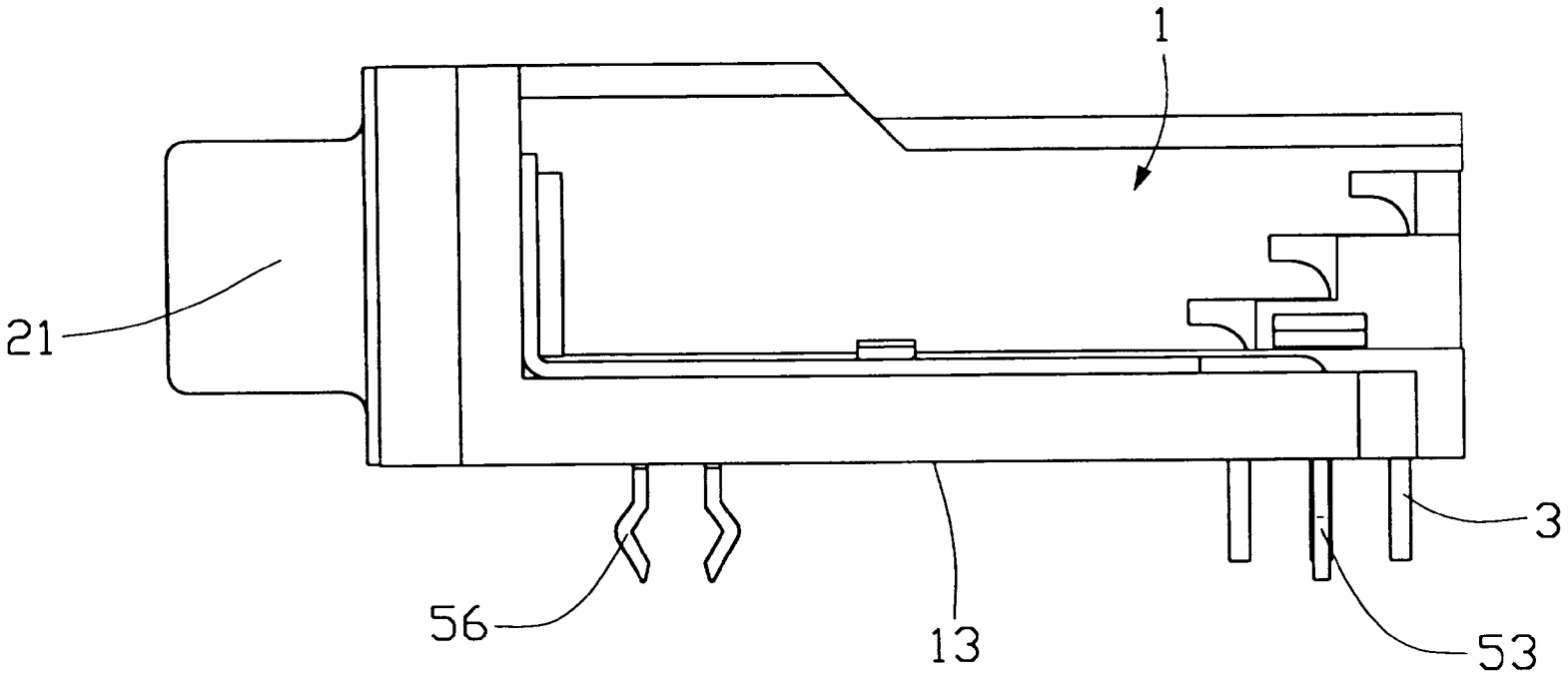
FIG. 4 is a side view of the assembled electrical connector.

Referring to FIGS. 2–4, an electrical connector comprises an insulative housing 1 having a D-shaped projection 16 extending from a front side thereof for engaging with a mating electrical device (not shown). The insulative housing 1 defines a plurality of passageways 17 for receiving corresponding contacts 3 therein. A metal shroud 2 is shaped with a frame 21 which defines a receiving space for receiving the corresponding D-shaped projection 16 therein. The metal shroud 2 defines a pair of fixing holes 23 at lateral sides thereof corresponding to a pair holes 161 of the insulative housing 1. A pair of extending plates 13 respectively extends on lateral sides of the housing 1. Each extending plate 13 defines a receiving space 14 therein. A protrusion 15 is formed adjacent to a rear side of a corresponding receiving space 14. Each protrusion 15 forms a pair of channels 151 at lateral sides thereof.

Figure 5:
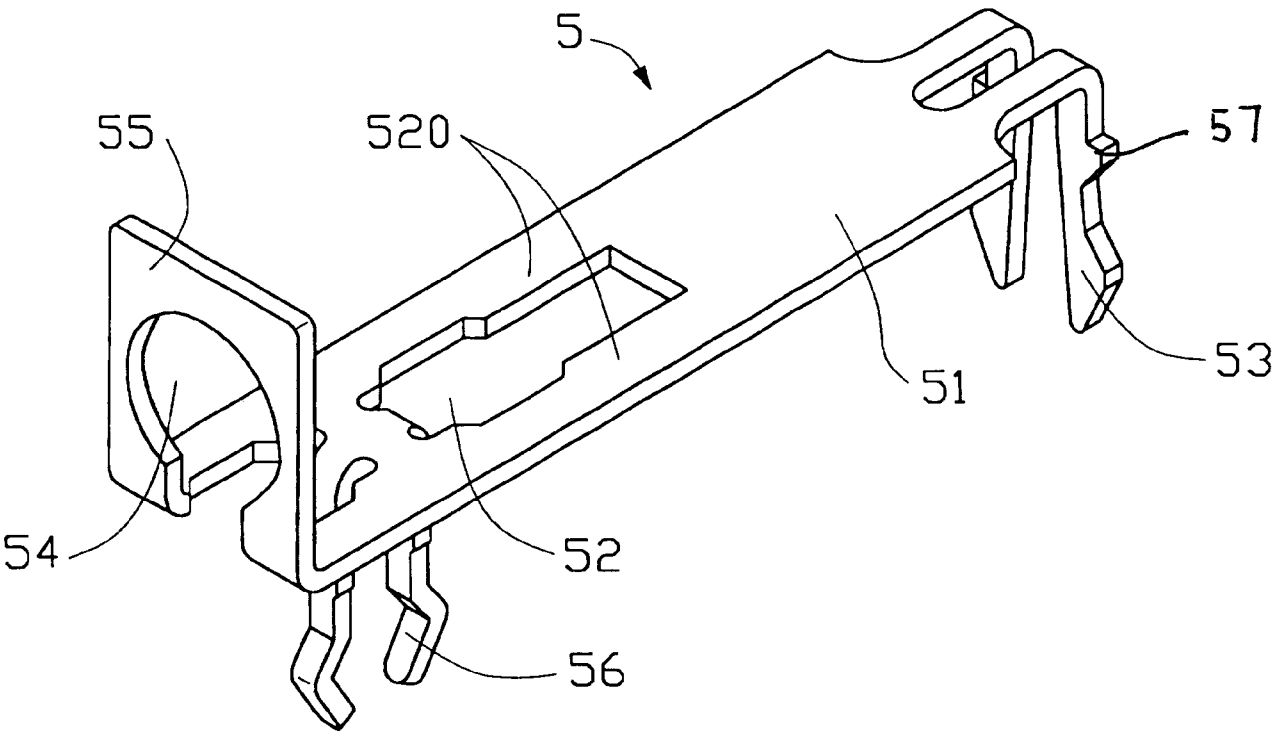
FIG. 5 is a perspective view of a fixing device in accordance with a first embodiment of the present invention.
Figure 6:
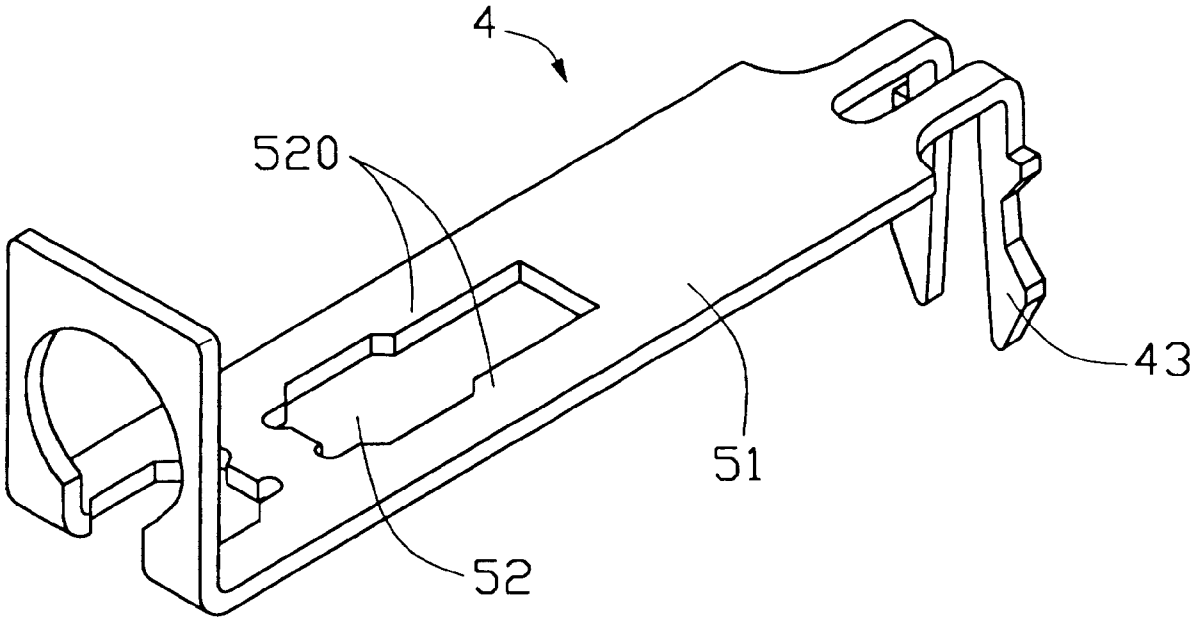
FIG. 6 is a perspective view of a fixing device in accordance with a second embodiment of the present invention.

Referring to FIGS. 5 and 6, the electrical connector further comprises a first type or second type of fixing device 5, 4. The first type fixing device 5 has an elongated body 51 which defines a mating opening 52 therein, pairs of front and rear boardlocks 56, 53, each with two spaced legs, which downwardly and perpendicular extend from the body 51 and are located respectively near a front end and at a rear end of the body 51. The body 51 forms a pair of engaging flanges 520 extending rearward at the sides of the opening 52. The opening has a wide front portion and a narrow rear portion. A mating portion 55 upwardly extends from the front end of the body 51 and defines a fixing hole 54 therein. The second type of fixing device 4 has a similar configuration to that of the first type of fixing device 5 except that the second type of fixing device 4 only has the rear boardlocks 43, without the front boardlocks 56.

During assembly, the front boardlocks 56 of the first type of fixing device 5 extend through the receiving space 14.

Then the engaging flanges 520 of the first type of fixing device 5 are moved to be received in corresponding channels 151 formed by the protrusion 15. Therefore, the fixing devices 5 can be properly assembled to the housing 1 at a predetermined position. The second type of fixing device 4 can be assembled to the housing 1 in a similar manner. A pair of fixing screws 6 is provided for extending through the fixing holes 54, 161 and 23 and engaging with corresponding screw caps (not shown). Thus, the first and second types of fixing device 5, 4 are securely attached to the housing 1. After the boardlocks 43, 53 and 56 respectively extend through corresponding holes defined in a circuit board (not shown), the electrical connector will be securely mounted on the circuit board.

It is noted that the boardlocks 53 is received within the recess 19 formed in the rear end of the extending plate 13 so as to restrain the lateral movement of the boardlocks 53 relative to the housing 1. Moreover, the boardlock further includes an abutment protrusion 57 on each side for engagement with the corresponding step 18 around the recess 19 so as to prevent upward movement of the boardlocsk 53 relative to the housing 1.

It is also noted that the mating opening 52 includes a larger front region 521 and a smaller rear region 522 so that the fixing device 5 can be assembled to the housing 1 from the top via the protrusion 15 passing through the larger front region 521 while the pair of engaging flanges 520 may be engagably received in the corresponding channels 151 of the protrusion 15 after the fixing device 5 is successively forwardly moved relative to the housing I for preventing upward movement of the fixing device 5 relative to the housing 1.

It is understood that in this embodiment, the fixing device 5 includes the boardlocks 53 and the boardlocks 56 which are generally aligned with each other in a front-to-back direction with a distance therebetween, wherein the boardlocks 56 lie in a plane perpendicular to another plane in which the boardlocks 53 lie. In addition, each of the boardlocks 53, 56 has the corresponding mechanism thereabouts for preventing vertical relative movement of the boardlocks with regard to the housing 1, i.e., the protrusion 15 vs. the engaging flanges 520 for the boardlocks 56, and the abutment protrusion 57 vs. the step 19 for the boardlocks 53. These structures assures the functions of the boardlocks thereof even though the body 51 extends relatively far from the mating portion 55 in comparison with the shorter type prior art fixing device.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having an elongated body which defines a plurality of passageways therein, and a pair of extending plates respectively extending on lateral sides of the body, each extending plate defining a receiving space therein;

a plurality of contacts received in the passageways;

at least a fixing device secured to the housing, having a body and at least a pair of boardlocks downwardly extending from the body through one of the extending plate for mounting the electrical connector on a circuit board, a mating opening defined in the body, a pair of engaging flanges formed on the body extending at the sides of the opening, the flanges engaging with the housing for properly assembling the fixing device to the insulative housing;

wherein a mating portion extends upwardly from a front end of the body and defines a fixing hole therein;

wherein the extending plate forms a protrusion adjacent to the rear end of the receiving space;

wherein the protrusion defines a pair of channels at lateral sides thereof;

wherein the housing defines a pair of holes at lateral sides thereof;

wherein the mating opening comprises a narrow portion which forms the pair of engaging flanges for accommodating the channels defined by the protrusions;

wherein a pair of fixing screws extend through corresponding fixing holes of the fixing device and holed of the insulative housing for assembling the electrical connector together;

wherein a pair of boardlocks downwardly extend from a rear end of the body;

wherein a pair of boardlocks downwardly extend from a front end of the body adjacent to the mating opening.

* * * * *